US007602347B2

(12) United States Patent
Flynn et al.

(10) Patent No.: US 7,602,347 B2
(45) Date of Patent: Oct. 13, 2009

(54) SQUINT-BEAM CORRUGATED HORN

(75) Inventors: Stephen John Flynn, Headley (GB); Neil Wolfenden, Warfield (GB); Andrew Baird, Bramley (GB); Craig Mitchelson, Cumbernauld (GB)

(73) Assignee: Raven Manufacturing Ltd., Accrington (GB)

( * ) Notice: Subject to any disclaimer, the term of this patent is extended or adjusted under 35 U.S.C. 154(b) by 319 days.

(21) Appl. No.: 11/423,256

(22) Filed: Jun. 9, 2006

(65) Prior Publication Data

US 2007/0285329 A1 Dec. 13, 2007

(51) Int. Cl.
*H01Q 13/00* (2006.01)

(52) U.S. Cl. ..... 343/786

(58) Field of Classification Search ..... 343/786, 343/776, 771–772, 753
See application file for complete search history.

(56) References Cited

U.S. PATENT DOCUMENTS

| | | | | |
|---|---|---|---|---|
| 4,490,696 | A * | 12/1984 | Takeda et al. | 333/137 |
| 5,552,797 | A * | 9/1996 | Cook | 343/786 |
| 6,020,859 | A * | 2/2000 | Kildal | 343/781 CA |
| 6,480,165 | B2 | 11/2002 | Moheb et al. | |
| 6,714,165 | B2 | 3/2004 | Verstraeten | |
| 6,720,932 | B1 | 4/2004 | Flynn et al. | |
| 6,720,933 | B2 | 4/2004 | Hanlin et al. | |
| 6,831,612 | B2 * | 12/2004 | King et al. | 343/772 |
| 6,937,202 | B2 * | 8/2005 | Chandler | 343/786 |
| 6,982,679 | B2 * | 1/2006 | Kralovec et al. | 343/781 CA |
| 7,084,815 | B2 * | 8/2006 | Phillips et al. | 343/700 MS |
| 7,379,030 | B1 * | 5/2008 | Lier | 343/786 |

* cited by examiner

*Primary Examiner*—Huedung Mancuso
(74) *Attorney, Agent, or Firm*—Babcock IP, PLLC

(57) ABSTRACT

A feed having a waveguide with a longitudinal axis. A plurality of corrugations extending from an end of the waveguide. The corrugations coaxial with the longitudinal axis, forming an extension of the waveguide. The corrugations having an end face angle less than 90 degrees with respect to the longitudinal axis to squint the feed beam.

16 Claims, 5 Drawing Sheets

SQUINT-BEAM CORRUGATED HORN

BACKGROUND

The reflector of a microwave reflector antenna is adapted to concentrate a reflected beam from a distant source such as a satellite upon a feed assembly positioned proximate a focal area of the reflector. In satellite communications systems such as consumer broadcast satellite television and or internet communications, a single reflector antenna having multiple feeds may receive signal(s) from multiple satellites arrayed in equatorial orbit. A central feed is arranged on a primary beam path from a center satellite to the reflector and from the reflector to the feed. Side feeds configured for additional offset satellite beam paths directed to adjacent and or nearby satellites use the same reflector but are arranged at a desired angle to either side of the primary beam path. One or more feeds may each be offset from the center position.

To achieve optimum performance, the central axis of the central feed and the central axis of the side feeds may not be parallel. Because the central axes of the feed horns and associated waveguides of the main and side feeds are not parallel to one another, die casting of a common multi-beam feed assembly including side feeds has not previously been practical as the part of the tool that forms each feed cannot withdraw in a single direction. Therefore, prior feed assemblies including side feeds typically included a separate enclosure for each side feed and either an electrical cable connection between each sidecar and the central unit or separate cables between the sidecar and central units and the Indoor unit. These extra enclosures and interconnections increase the resulting antenna weight, wind load and overall cost.

The increasing competition for mass market consumer reflector antennas has focused attention on cost reductions resulting from increased materials, manufacturing and service efficiencies. Further, reductions in required assembly operations and the total number of discrete parts are desired.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

Figure 1:
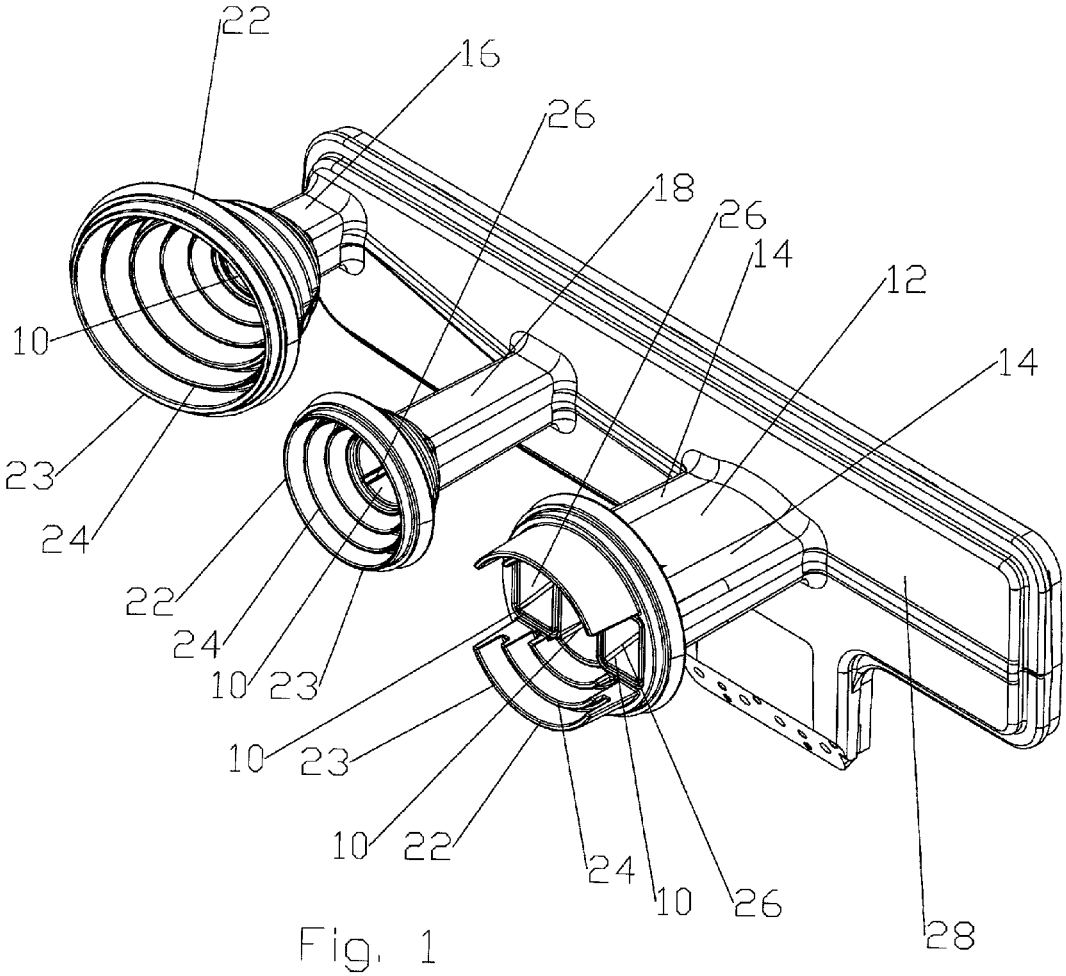
FIG. 1 is a schematic angled isometric view of the front end of a feed assembly according to an exemplary embodiment of the invention.
Figure 2:
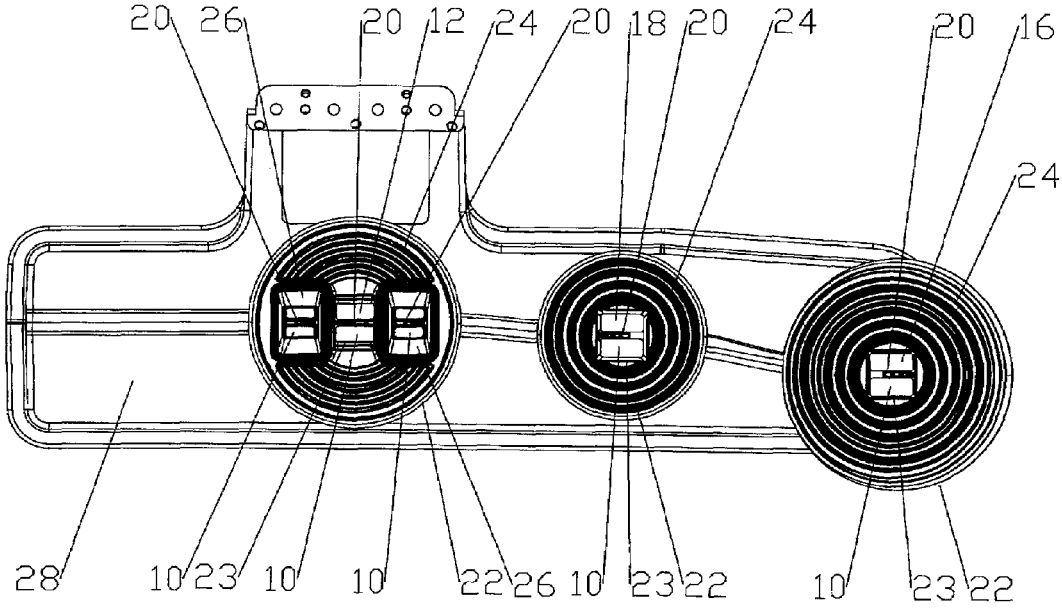
FIG. 2 is a schematic top side view of the feed assembly shown in FIG. 1.
Figure 3:
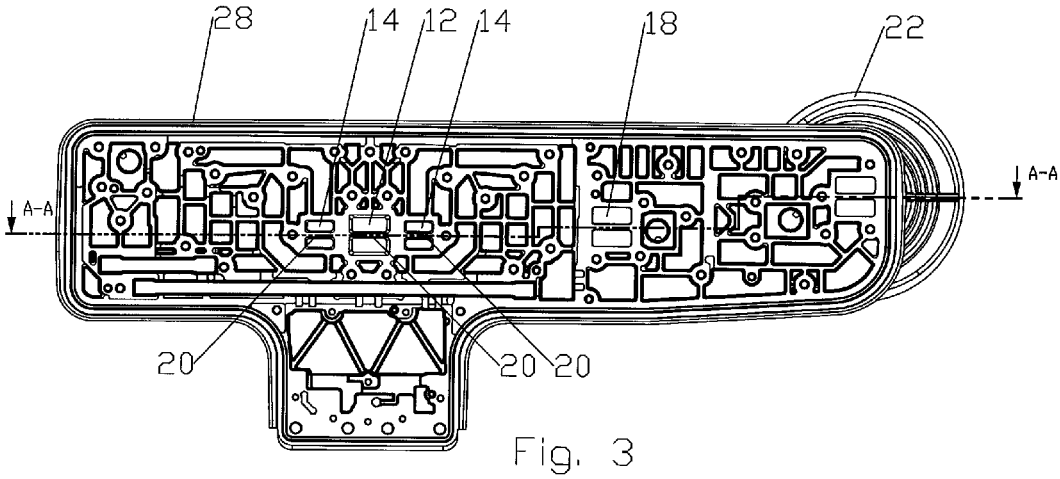
FIG. 3 is a schematic bottom side view of the front end of the feed assembly shown in FIG. 1.

The inventors have recognized that addition of beam squint to a feed horn results in an offset beam pattern. This offset beam pattern has been advantageously applied to form a side feed having a longitudinal axis that is parallel to the longitudinal axis of a central feed, but with an offset beam path. Thereby, a multiple feed assembly usable with a range of non-parallel beam paths may be cost efficiently formed via die casting with a high degree of precision.

As shown in FIGS. 1-4 a front end of a multiple feed assembly has five feeds, each comprising an open ended waveguide 10 having a longitudinal axis parallel to the others. A central feed 12 is adapted for a primary beam, for example reflected from an associated reflector (not shown). A pair of adjacent feeds 14 are adapted to receive signals from closely spaced satellites. A first side feed 16 is located spaced away from the central and adjacent feeds 12, 14. A second side feed 18 is located between the first side feed 16 and the central feed 14. Each of the waveguide(s) 10 of the feeds may be rectangular or other desired geometry. A septum polarizer 20 may be positioned within each of the waveguide(s) 10 for separation of signal polarities.

Figure 4:
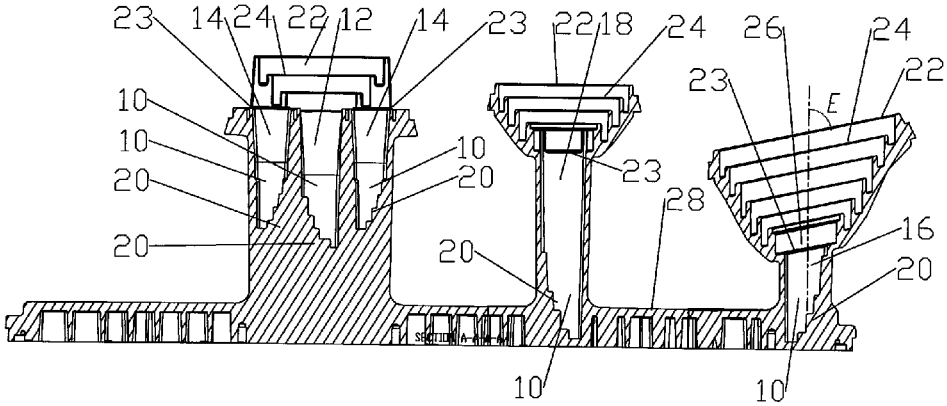
FIG. 4 is a schematic cutaway side view of the feed assembly of FIG. 3, along line A-A.

The central, first and second side feeds 12, 16, 18 have a corrugated conical horn 22 extending from the open end of their respective waveguide(s). As best shown in FIG. 4, the waveguide(s) 10 and the corrugation(s) 24 of the corrugated horn(s) 22 each have a longitudinal axis that are generally parallel to one another. The desired offset of the beam path for the first side feed 16, with respect to the primary beam, is achieved by applying an angle E to a plane of the end face 23 of the corrugation(s) 24 with respect to the longitudinal axis of the first side feed 16 waveguide 10.

The corrugation(s) 24 are demonstrated in the exemplary embodiment as generally circular and concentric. Alternatively, the corrugation(s) 24 may be non circular and applied in any of a range of straight and or angled combinations with uniform or varied heights and spacing for the particular application and or operating frequencies desired. Similarly, equivalents to the corrugation(s) 24 may be formed, for example, as steps or a single corrugation represented by the open end 26 of the waveguide 10 or a flared extension of the waveguide 10 end, any of the equivalents having an end angle according to the invention. To prevent interference with the adjacent feed(s) 14, the corrugated conical horn 22 of the central feed 12 may be cut-away from areas of the beam path(s) of the adjacent feed(s) 14.

Figure 5:
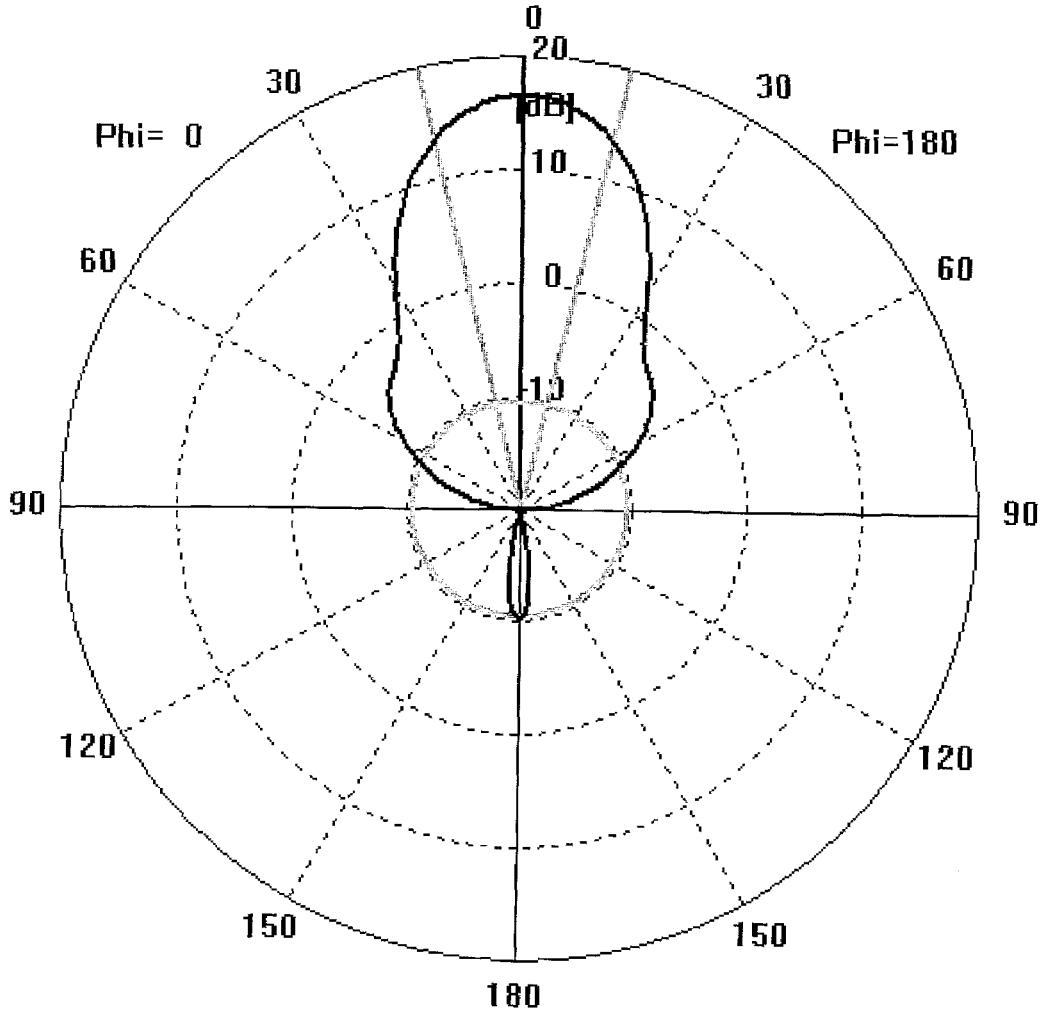
FIG. 5 is a chart showing the radiation pattern of a conventional prior art conical corrugated feed with a corrugation end face angle normal to the longitudinal axis of the feed.
Figure 6:
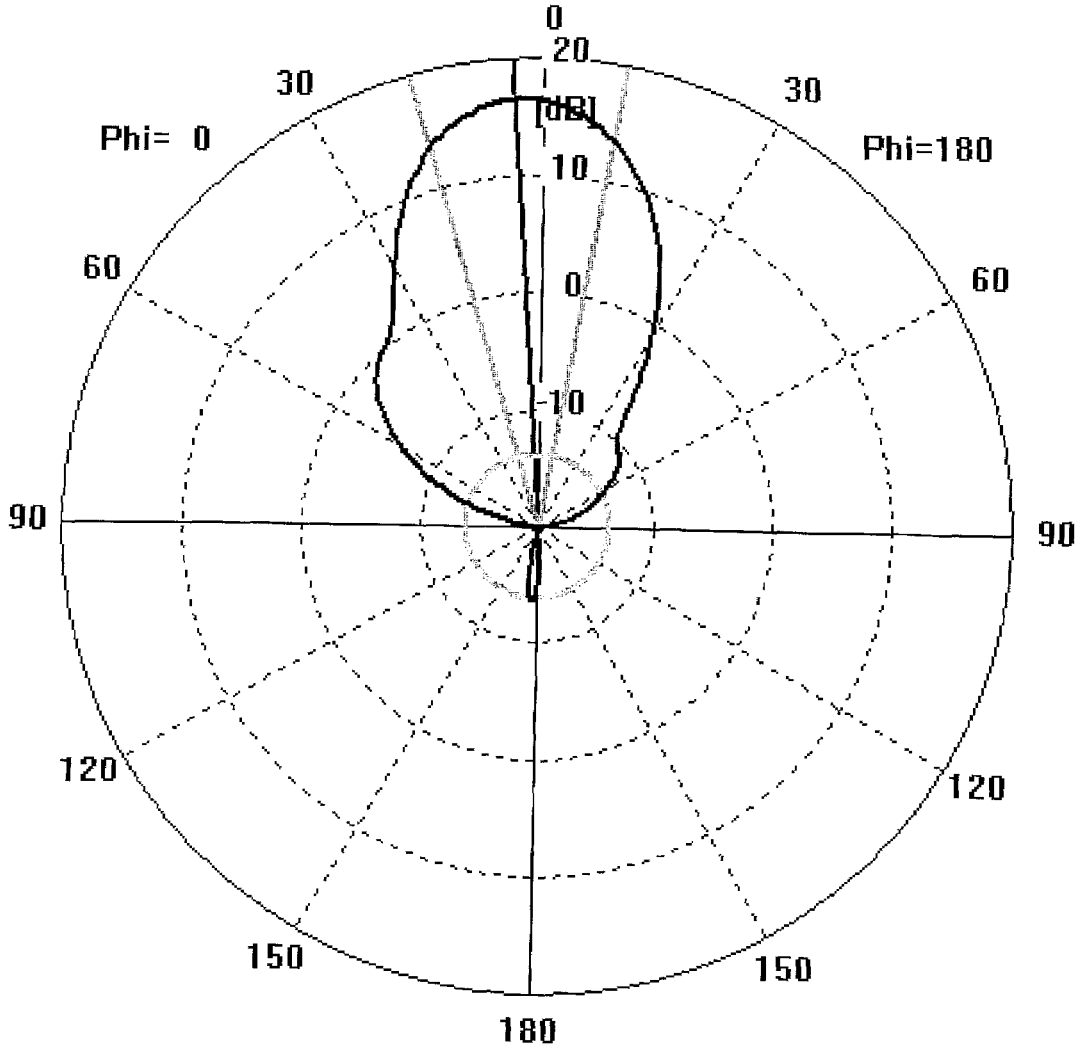
FIG. 6 is a chart showing the radiation pattern of a conical corrugated feed according to the invention with a corrugation end face angle less than normal to the longitudinal axis of the feed.

As shown for example in FIG. 5, where the corrugations of a corrugated conical feed horn 22 each have an end face 23 that is normal to the longitudinal axis of the feed, a uniform radiation pattern is formed. As the end face 23 angle E of the feed horn corrugations with respect to the longitudinal axis is reduced from 90 degrees, an increasing beam squint occurs towards the low side of the end face(s) 23. The radiation pattern resulting from the increased beam squint, for example as shown in FIG. 6, is weighted away from the longitudinal axis towards the low side of the end face(s) 23. Thereby, a feed according to the invention can be aimed towards a beam path that has an offset angle from the longitudinal axis of the feed.

In the exemplary embodiment, the first side feed end face angle of the feed horn is 78 degrees with the low and high sides along a horizontal axis of the assembly. Depending upon the offset from the primary beam desired, the end face angle E may be adjusted, for example to any angle less than 90 degrees. Also, to account for changes in the relative elevation of target satellites positioned along a horizon arc in equatorial orbit, with respect to the terrestrial position of the antenna, the vertical spacing of the feeds upon the baseplate 28, for example measured relative to a horizontal axis of septum polarizer(s) 20 positioned in the waveguide(s) 10, may be adjusted. Alternatively, it should also be appreciated that by adjusting the orientation of the end face plane low and high sides, the beam may be configured for varying beam squint in azimuth and or elevation for each of a plurality of different side feeds.

One skilled in the art will recognize that the present invention allows the creation of feed assemblies having multiple feeds with parallel longitudinal axes, the multiple feeds having a range of different beam path(s). Because the longitudinal axes of the multiple feeds and corrugations, if present, are parallel, a feed assembly according to the invention has no overhanging edges, allowing high volume cost efficient fabrication of the feed assembly via molding or die casting. Where a dielectric material such as plastic is used as the material for injection molding, a conductive surface coating may be applied.

Because molding or die casting precisely and permanently orients each of the feeds as desired, the prior manufacturing and or installation steps of separately attaching, interconnecting and or aiming of the sidecar feeds has been eliminated. Where the desired angle of the side feed beam path(s) may change due to sale within different markets and or geographic location, the feed assembly may be adapted to have exchangeable corrugated conical feed horn(s) 22. By exchanging one corrugated feed horn having one end face angle for another, the desired beam path may be quickly changed with a high degree of precision.

| | |
|---|---|
| 10 | waveguide |
| 12 | central feed |
| 14 | adjacent feed |
| 16 | first side feed |
| 18 | second side feed |
| 20 | septum polarizer |
| 22 | corrugated conical horn |
| 23 | end face |
| 24 | corrugation |
| 26 | open end |
| 28 | baseplate |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A feed with a longitudinal axis, comprising:

a waveguide;

at least one corrugation(s) extending from an end of the waveguide;

the corrugation(s) coaxial with the longitudinal axis, forming an extension of the waveguide;

the corrugation(s) having an end face angle less than 90 degrees with respect to the longitudinal axis;

the waveguide and the at least one corrugation(s) extending from the end of the waveguide forming a first side feed formed as a unitary element also including a central feed; the central feed spaced away from the first side feed and having a central feed longitudinal axis that is parallel to the longitudinal axis of the side feed.

2. The feed of claim 1, wherein the at least one corrugation is the open end of the waveguide.

3. The feed of claim 1, wherein the at least one corrugation is at least one step of increasing diameter greater than the end of the waveguide.

4. The feed of claim 1, further including a pair of adjacent feeds formed on opposing sides of the central feed.

5. The feed of claim 4, wherein the central feed has at least one corrugation(s) extending from an end of the central feed;

the corrugation(s) coaxial with the longitudinal axis, forming an extension of the waveguide;

the corrugations cut away from an open end of the adjacent feeds.

6. The feed of claim 1, further including a second side feed positioned between the first side feed and the central feed.

7. The feed of claim 1, wherein the first side feed and the central feed are formed with a vertical offset along a horizontal axis.

8. The feed of claim 1, wherein a polarizing septum is positioned within each of the first side feed and the central feed; the polarizing septums having a vertical offset with respect to each other.

9. The feed of claim 1, wherein the end face angle is less than 90 and greater than 60 degrees.

10. The side feed of claim 1, wherein the extension is removable from the end of the waveguide.

11. A feed assembly, comprising:

a first side feed having a waveguide with an open end;

at least one corrugation(s) extending from the open end of the waveguide;

the corrugation(s) coaxial with a first side feed longitudinal axis, forming an extension of the waveguide with an increasing diameter;

the corrugation(s) having an end face angle less than 90 degrees with respect to the feed waveguide longitudinal axis; and a central feed spaced away from the first side feed and having a central feed waveguide longitudinal axis that is parallel to the side feed longitudinal axis;

the first side feed and the central feed extending from a base plate, the first side feed and the central feed having a vertical offset along a horizontal axis.

12. A method for manufacturing a feed, comprising the steps of:

forming a waveguide having at least one corrugation(s) extending from an end of the waveguide;

the corrugation(s) coaxial with a longitudinal axis of the waveguide, forming an extension of the waveguide;

the corrugation(s) having an end face angle less than 90 degrees with respect to the longitudinal axis;

the waveguide and the at least one corrugation(s) extending from the end of the waveguide forming a first side feed formed as a unitary element also including a central feed; the central feed spaced away from the first side feed and having a central feed longitudinal axis that is parallel to the longitudinal axis of the side feed.

13. The method of claim 12, wherein the first side feed and the central feed have a vertical offset along a horizontal axis.

14. The method of claim 12, wherein the waveguide is formed via die casting.

15. The method of claim 12, wherein the waveguide is formed via injection molding.

16. The method of claim 15, further including the step of coating the waveguide with a conductive material.

* * * * *